US007196483B2

(12) United States Patent
Wey et al.

(10) Patent No.: US 7,196,483 B2
(45) Date of Patent: Mar. 27, 2007

(54) BALANCED CIRCUIT FOR MULTI-LED DRIVER

(75) Inventors: Chin-Der Wey, Houlong Township, Miaoli County (TW); Ya-Yun Yu, Banciao (TW); Hsien-Jen Li, Hemei Township, Changhua County (TW); Yueh-Pao Lee, Hukou Township, Hsinchu County (TW)

(73) Assignee: AU Optronics Corporation, Hsinchu (TW)

( * ) Notice: Subject to any disclaimer, the term of this patent is extended or adjusted under 35 U.S.C. 154(b) by 124 days.

(21) Appl. No.: 11/156,288

(22) Filed: Jun. 16, 2005

(65) Prior Publication Data

US 2006/0284569 A1 Dec. 21, 2006

(51) Int. Cl.
*H05B 37/00* (2006.01)
*H05B 41/14* (2006.01)

(52) U.S. Cl. ..... 315/312; 315/277

(58) Field of Classification Search ..... 315/178, 315/200 R, 205–207, 267–268, 272, 277; 362/800, 802, 803, 806
See application file for complete search history.

(56) References Cited

U.S. PATENT DOCUMENTS 6,104,146 A 8/2000 Chou et al. ..... 315/277
6,420,839 B1 * 7/2002 Chiang et al. ..... 315/311
6,466,188 B1 * 10/2002 Cato ..... 345/82
6,529,182 B1 3/2003 Burton ..... 345/102
6,534,934 B1 * 3/2003 Lin et al. ..... 315/312
6,680,834 B2 1/2004 Williams ..... 361/58
6,717,372 B2 4/2004 Lin et al. ..... 315/282
6,750,842 B2 6/2004 Yu ..... 345/102
6,784,627 B2 * 8/2004 Suzuki et al. ..... 315/291
6,972,742 B2 12/2005 Dennehey ..... 345/76
7,106,009 B2 * 9/2006 Huang ..... 315/308
7,141,933 B2 * 11/2006 Ball ..... 315/5
2003/0141829 A1 7/2003 Yu et al. ..... 315/276

* cited by examiner

*Primary Examiner*—Shih-Chao Chen
*Assistant Examiner*—Minh Dieu A
(74) *Attorney, Agent, or Firm*—Ware, Fressola, Van Der Sluys & Adolphson LLP

(57) ABSTRACT

A driving circuit uses a plurality of transformers to provide currents for driving a plurality of LEDs associated with a plurality of current paths. Each transformer has two induction coils with a coil turn ratio between to the number of turns in each induction coil. One induction coil is used to provide an output current to a different current path and the other induction coil is connected to the corresponding induction coil of other transformers for forming a current loop. The output current of each transformer has a relationship with the output current of the other transformers depending on the coil turn ratios of the connected transformers. LEDs in red, blue and green colors can be connected to different current paths so that the brightness of the LEDs in each color can be determined by the current in a current path.

9 Claims, 10 Drawing Sheets

BALANCED CIRCUIT FOR MULTI-LED DRIVER

FIELD OF THE INVENTION

The present invention relates generally to a driving circuit for driving a plurality of light-emitting devices and, more particularly, to a driving circuit having a plurality of current paths each of which is connected to one or more light-emitting devices.

BACKGROUND OF THE INVENTION

Light-emitting devices (LEDs) are commonly used in a back-lighting source for a liquid crystal display (LCD) panel. In particular, LEDs in red, green and blue colors are used to provide a back-lighting source in "white" color. In prior art, when a driving circuit is used to drive a display having one or more strings of light-emitting devices (LEDs), these strings are connected in parallel to form a single current supply path. As shown in FIG. 1, a current limiting device and a current limiting resistor Rcl are used to regulate the total current in the current supply path. In such a driving circuit, a voltage boosting device is used as a power supply to supply the current to the LEDs. Alternatively, a current sensing device is used to provide a feedback to the voltage boosting device in order to regulate the total current in the current supply path, as shown in FIG. 2.

In the driving circuits as shown in FIGS. 1 and 2, it is assumed that the current through each of the string of LEDs is substantially the same. However, because the non-linear relationship between the voltage drop and the current in an LED, one or more slightly irregular LEDs in a string may cause the current through that LED string to increase significantly. As such, the useful operational life of the LEDs in that string may be significantly shortened. If the strings of LEDs are used to provide in a white back-lighting source, the color balance in the back-lighting source may be shifted because the brightness in one string is different from the brightness in other strings.

It is possible to use a separate driving circuit for each string of LEDs. For example, a current regulator with a voltage upgrade feature can be used to regulate the current through the LED string. As shown in FIG. 3, the current regulator regulates the current by sensing the voltage across the current sensing resistor Rcs. While this type of current regulator is very effective in regulating current, it is not a cost-effective solution. Furthermore, this type of current regulator produces a significant amount of electromagnetic radiation that could be a problematic source of electromagnetic interference (EMI).

Alternatively, a group of LEDs of the same color can be connected in parallel and each parallel current path has a separate current limiting resistor in a voltage regulator as shown in FIG. 4 and in a current regulator as shown in FIG. 5. However, the electrical characteristic of the LEDs in each parallel current path must be examined and matched so that the currents through the parallel current paths can be equalized.

It is thus desirable and advantageous to provide a method and a device that is cost effective and effective in regulating the current in each group of color LEDs in a back-lighting source.

SUMMARY OF THE INVENTION

The driving circuit for driving multiple light-emitting devices in a plurality of current paths, according to the present invention, uses a plurality of transformers coupled with each other such that one of the induction coils in each transformer is connected to one of the induction coils of the other transformers and these connected induction coils are connected in series to form a complete current loop. As such, the output current of one transformer has a certain relationship to the output current of the other transformers through mutual inductance. For example, in a driving circuit where only two transformers are used, one of the induction coils of the first transformer is connected to one of the induction coils of the second transformer to form a current loop. The magnetic flux produced by the output current of the first transformer induces a current in the current loop. Likewise, the magnetic flux produced by the output current of the second transformer induces the same current in the current loop. Thus, depending upon the coil turn ratio in each the transformer, the output current of the first transformer has a substantially fixed relationship with the output current of the second transformer. As such, when the driving circuit is used to provide a plurality of current paths, the current in each current path can be selected by the coil turn ratio in a transformer relative to the coil turn ratio of another transformer.

The driving circuit of the present invention can be used in a light source of various colors by using light-emitting devices of desirable colors. For example, the light-emitting devices can have a mixture of red, green and blue light emitting devices so as to produce a white light source. The simplest white light source has a group of red light emitting devices, a group of green light emitting devices and a group of blue light emitting devices to produce red, green and blue color components. The driving circuit for this white light source has three group of current paths, each group for providing the same current to a group of color light-emitting devices. In order to achieve a desired balance among the different color components in the white light source, it is possible to adjust the number of light emitting devices of one or two colors without changing the driving circuit. Furthermore, it is possible to change the transformer coil turn ratios in an inverter driver or to use a pulse width modulator to adjust the current.

DETAILED DESCRIPTION OF THE INVENTION

Figure 1:
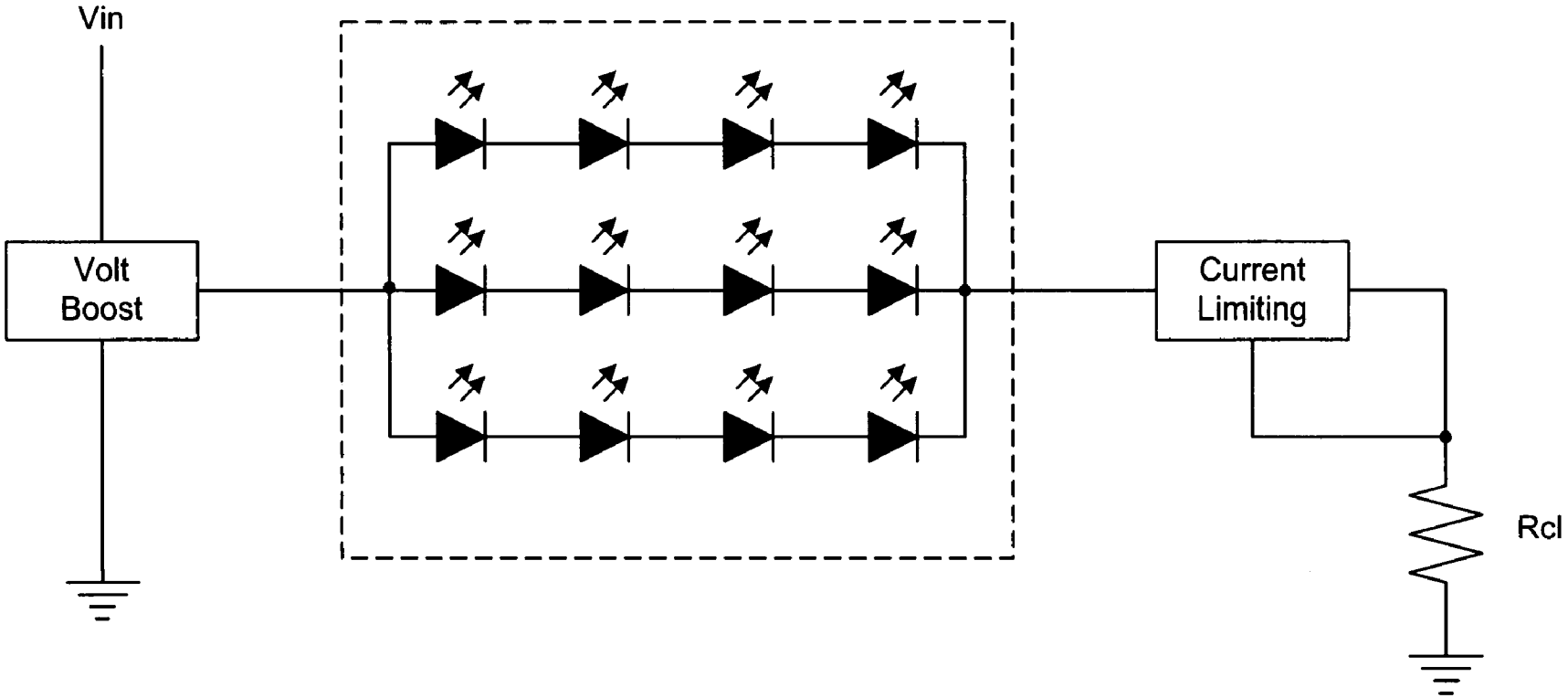
FIG. 1 (prior art)
FIG. 1 is a circuit diagram showing a prior art driving circuit.
Figure 2:
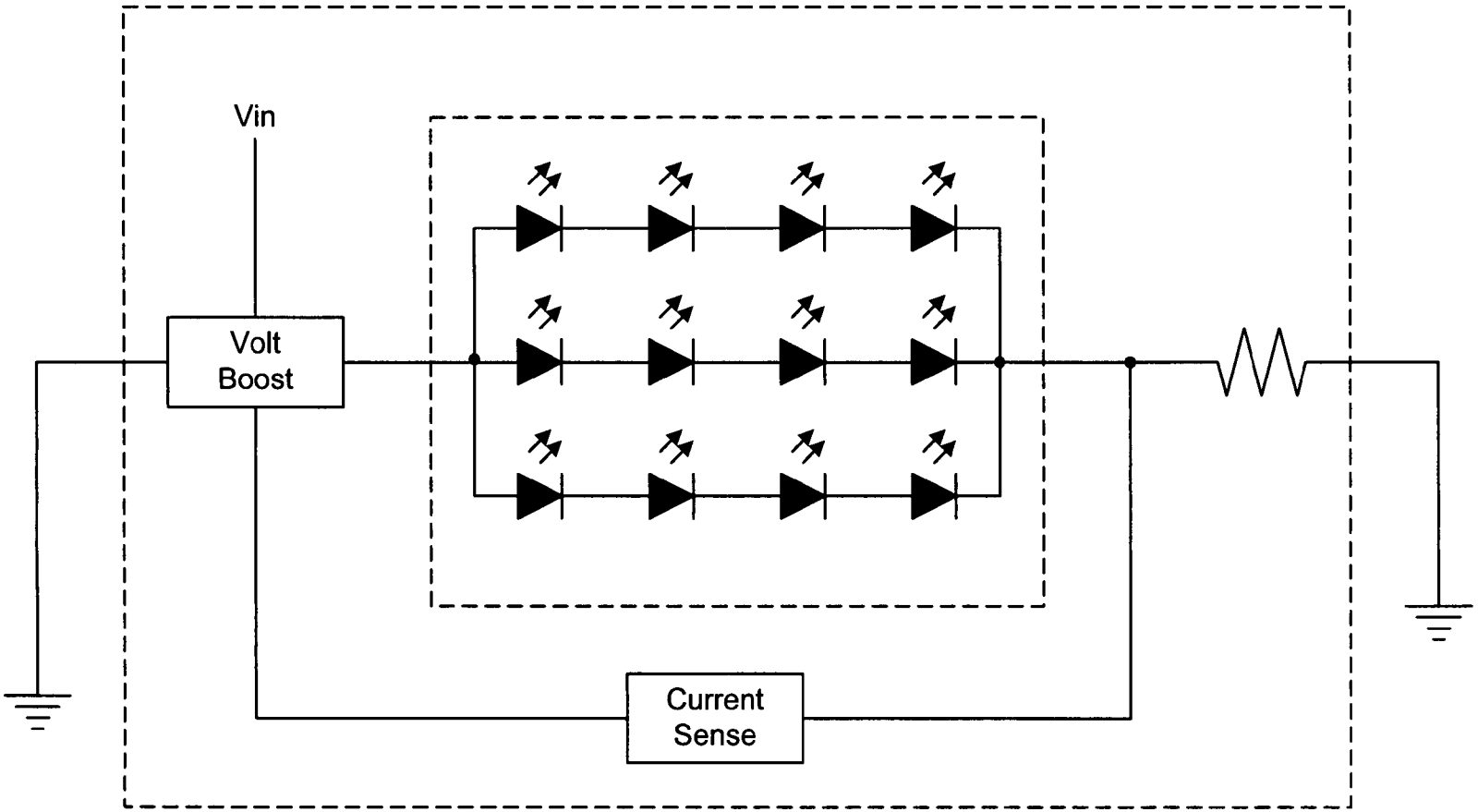
FIG. 2 (prior art)
FIG. 2 is a circuit diagram showing another prior art driving circuit.
Figure 3:
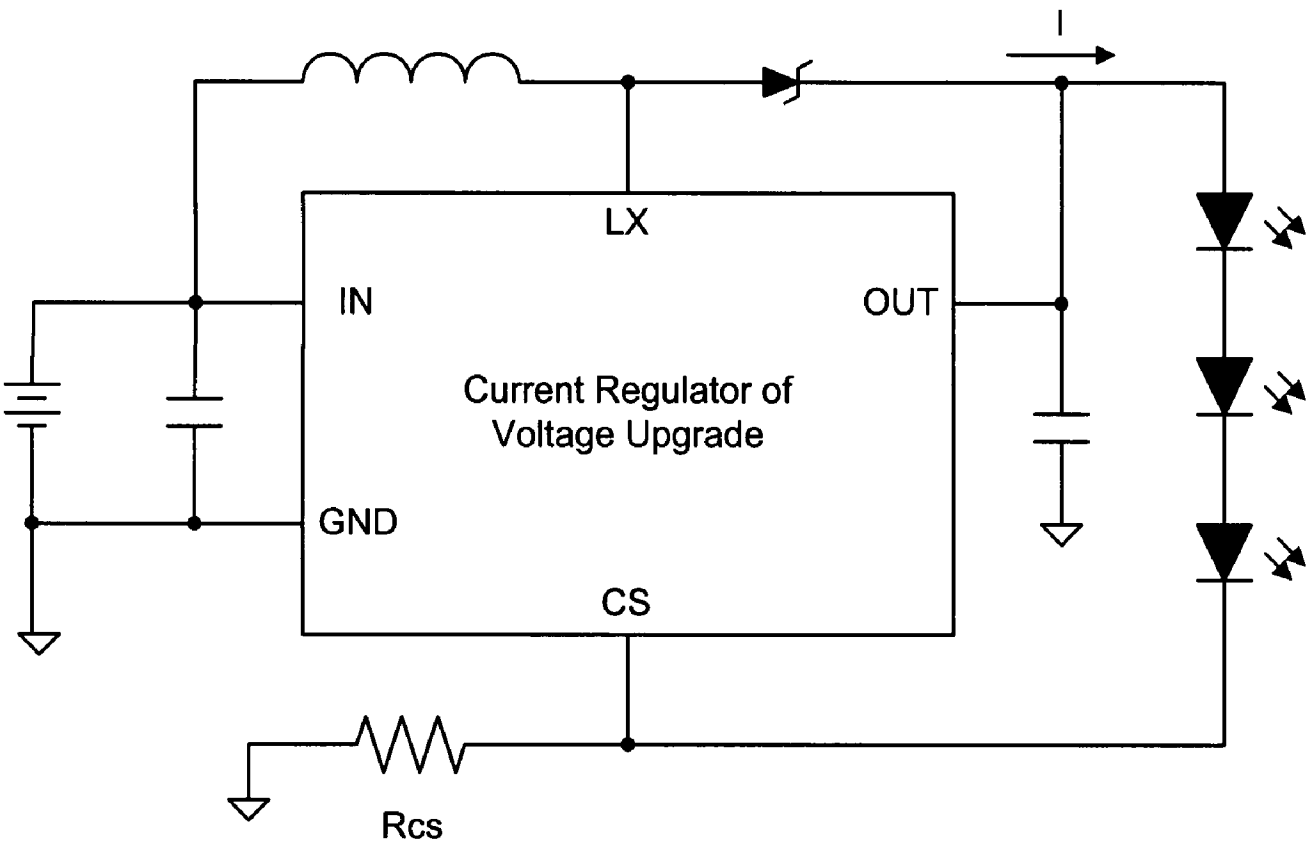
FIG. 3 (prior art)
FIG. 3 is a circuit diagram showing a prior art current regulator with voltage upgrade.
Figure 4:
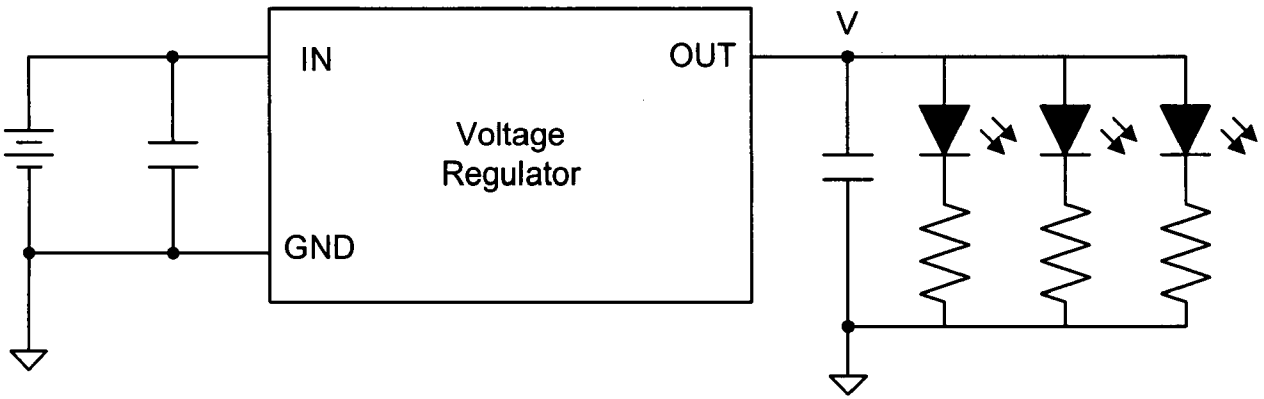
FIG. 4 (prior art)
FIG. 4 is a circuit diagram showing a prior art voltage regulator.
Figure 5:
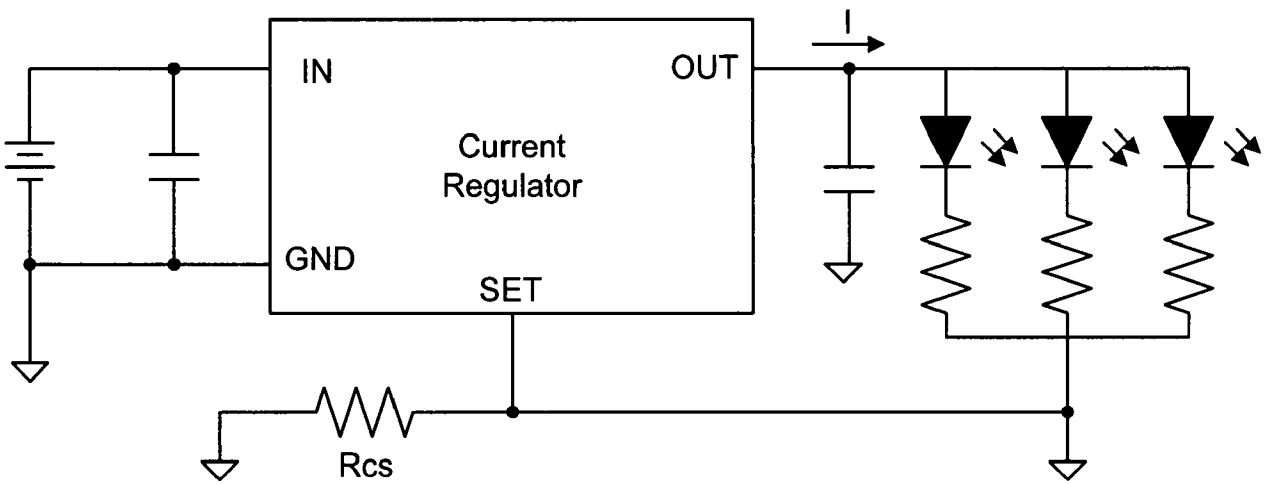
FIG. 5 (prior art)
FIG. 5 is a circuit diagram showing another prior art current regulator.
Figure 6:
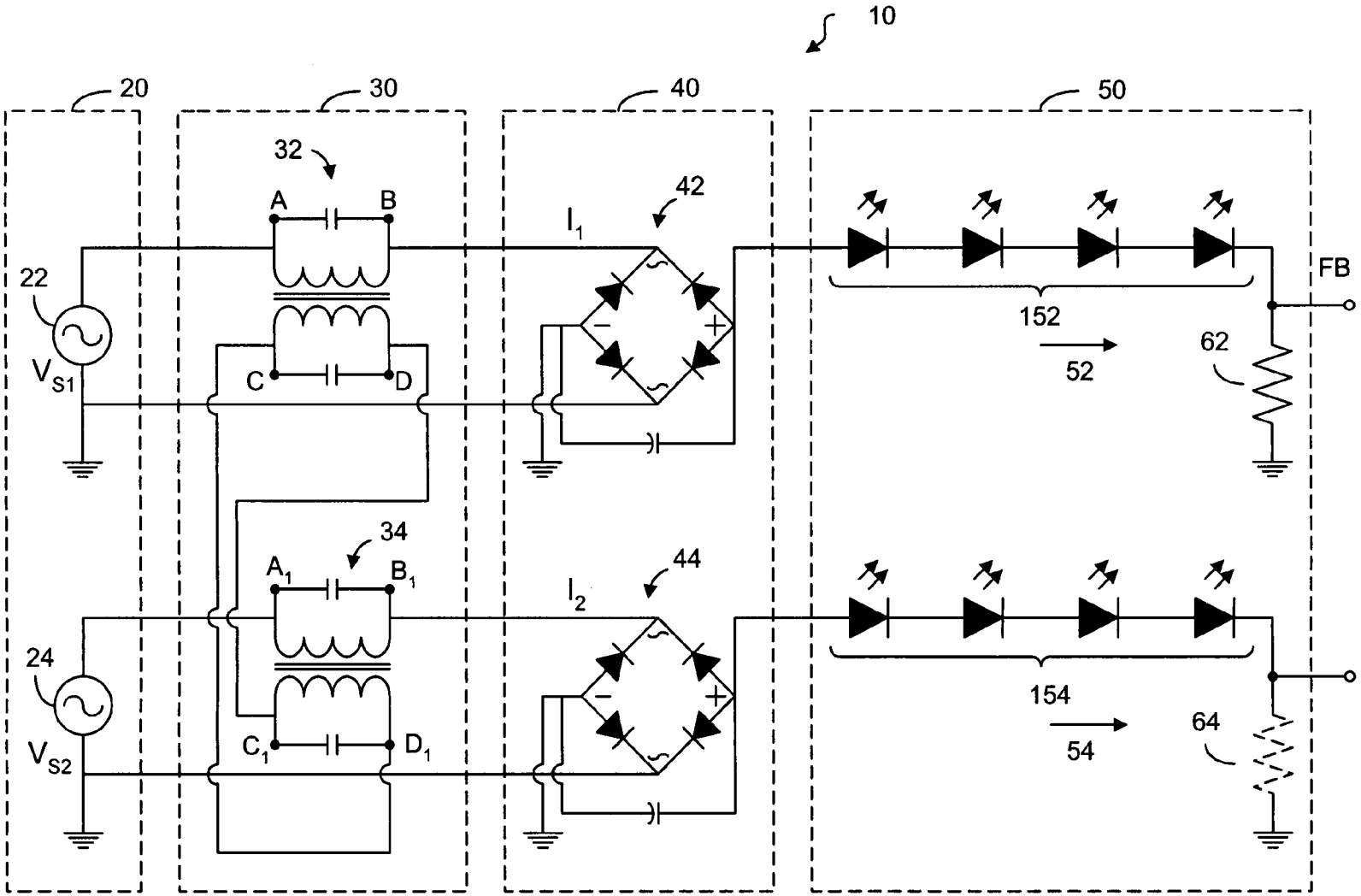
FIG. 6 is a circuit diagram showing an exemplary driving circuit, according to the present invention.

The driving circuit with a plurality of current paths for driving a plurality of light-emitting devices (LEDs), according to the present invention, is explained by way of examples as follows. FIG. 6 illustrates a lighting panel having a light source 50 and a driving circuit 10 having two current paths 52, 54 for driving two groups of LEDs 152 and 154 in the light source. The driving circuit 10 has an inverter driver block 20 operatively connected to a balanced transformer circuit 30 to provide output currents $I_1$ and $I_2$ through a rectifier block 40. The balanced transformer circuit 30 has a first transformer 32 and a second transformer 34 coupled to each other. The rectifier 40 has a first rectifier 42 connected to the first transformer 32 and a second rectifier 44 connected to the second transformer 34. The inverter driver block 20 has a first inverter driver 22 to supply power to the first transformer 32 and a second inverter driver 24 to supply power to the second transformer 34.

Figure 7:
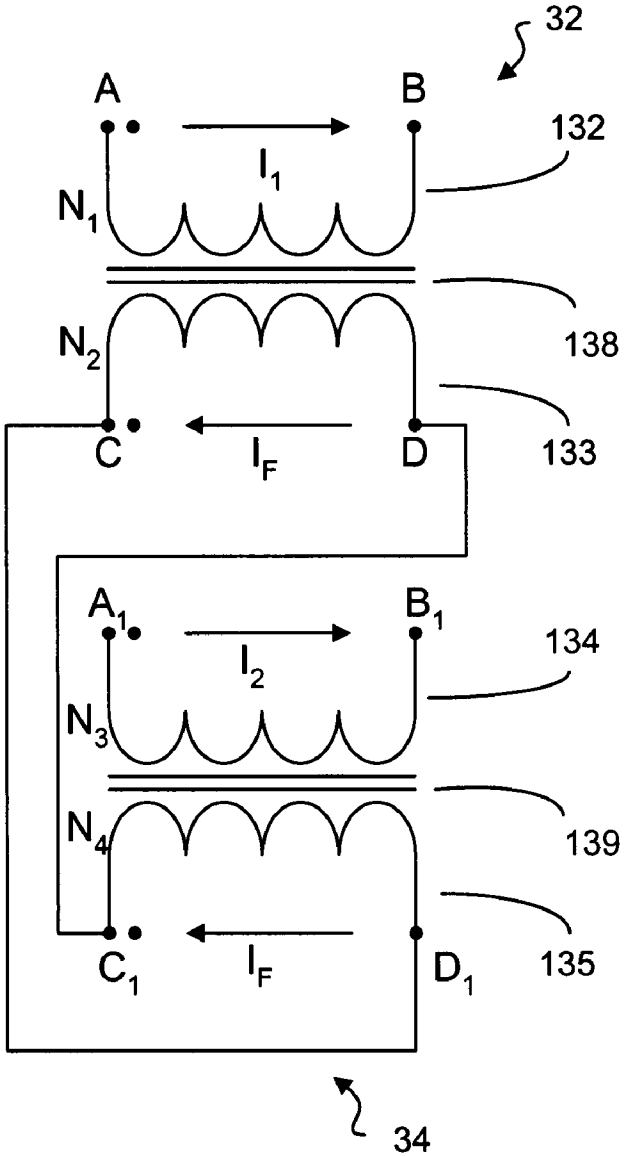
FIG. 7 is a circuit diagram showing the structure of a balanced transformer circuit, according to the present invention.

The coupling between the first and second transformers in the balanced transformer circuit is shown in FIG. 7. For illustration purposes, each transformer is assumed to be an ideal transformer in that the induction loss in the transformer is negligible such that the current through each of the transformer coils is determined by the coil turn ratio. In particular, the transformer has only two coils. As shown in FIG. 7, the transformer 32 has a first coil 132 having $N_1$ turns coupled to a second coil 133 having $N_2$ turns through a transformer core 138. The transformer 34 has a first coil 134 having $N_3$ turns coupled to a second coil 135 having $N_4$ turns through a transformer core 139. The second coil 133 of the first transformer is connected to the second coil 135 of the second transformer to form a current loop. If the output current of the first transformer 32 is $I_1$, then the magnetic flux produced by $I_1$ through the coil 132 induces an induction current $I_F$ in the coil 133 given by $$I_F=I_1(N_1/N_2) \tag{1}$$

Likewise, if the output current of the first transformer 34 is $I_2$, then the magnetic flux produced by $I_2$ through the coil 134 induces an induction current IF in the coil 135 given by $$I_F=I_2(N_3/N_4) \tag{2}$$

From Equations 1 and 2, we have $$I_1(N_1/N_2)=I_2(N_3/N_4)$$

$$I_2/I_1=(N_1/N_2)/(N_3/N_4) \tag{3}$$

Thus, the currents in the current paths are related to each other according to the coil turn ratios.

In FIG. 6, the coil turn ratio in each transformer is 1 and, therefore, $I_1=I_2$. It should be appreciated that the drivers 22, 24 must be capable of providing sufficient power to sustain the require currents. In FIG. 6, the LEDs 152 and the LEDs 154 are of the same type (substantially the same optical and electrical characteristics). With the same current in each current path, the brightness of each LED is substantially the same. Furthermore, because the number of LEDs 152 and the number of LEDs 154 are the same, the overall brightness produced by the LEDs associated with each current path is also substantially the same. As shown in FIG. 6, a resistor 62 is provided in the current path 52 so that a feedback signal can be obtained. However, the resister 64 in the current path 54 is optional.

Figure 8:
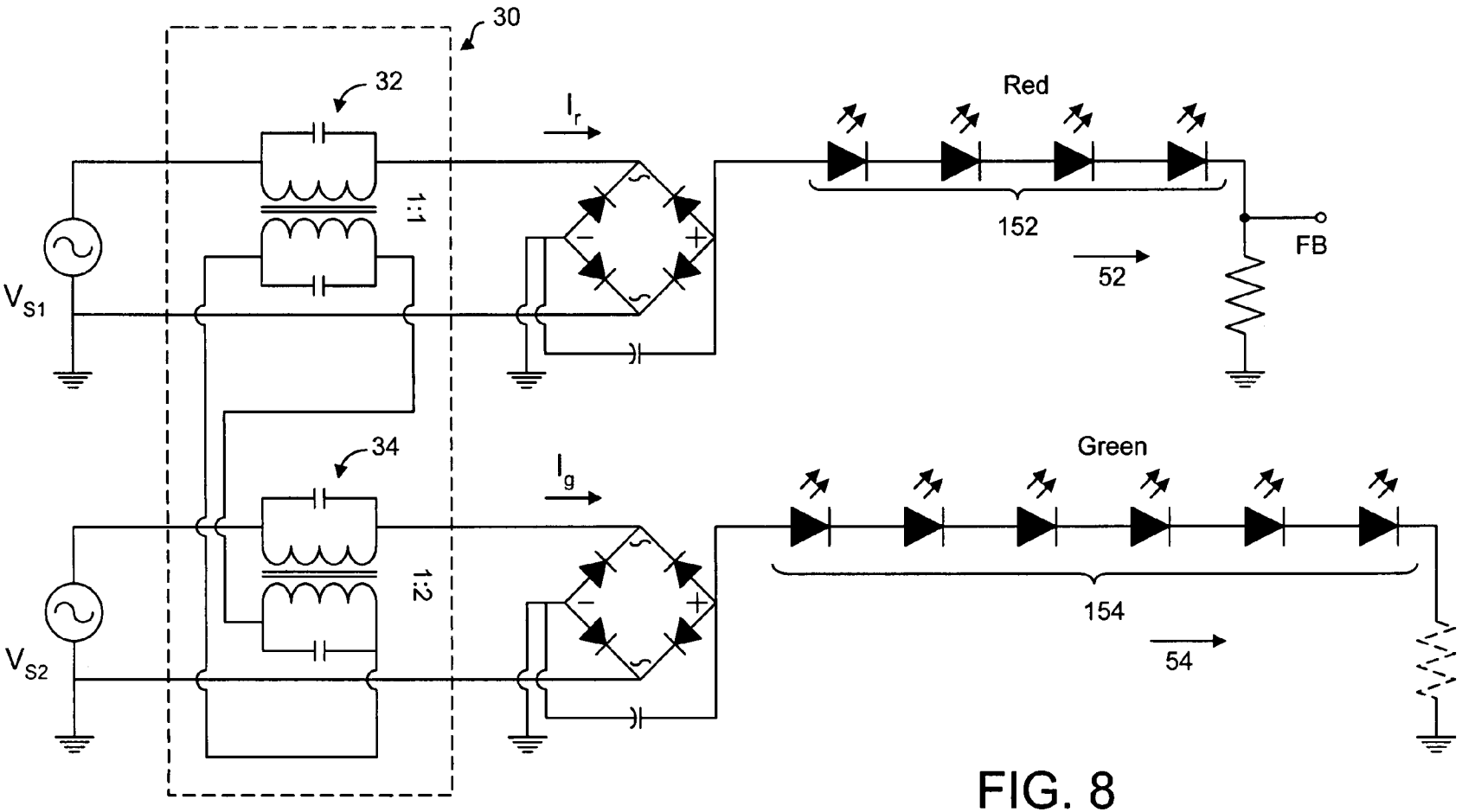
FIG. 8 is a circuit diagram showing another exemplary driving circuit having two current paths, according to the present invention.

If the LEDs in one current path are different from the LEDs in the other current path, it is possible to select transformers of different coil turn ratios to control the brightness of individual LEDs in a current path. For example, if the LEDs 152 in the first current path 52 are red and the LEDs 154 in the second current path 54 are green, it is possible to increase the brightness in the green LEDs by having a different coil turn ratio in the second transformer 34. As shown in FIG. 8, the coil turn ratio in the first transformer 32 is 1:1 and the coil turn ratio in the transformer 34 is 1:2. Accordingly, we have $$I_g/I_r=(N_1/N_2)/(N_3/N_4)=1/(1/2)=2$$

or $$I_g=2I_r$$

Furthermore, the overall brightness in green color can be increased by increasing the number of green LEDs 154 in the current path 54 without changing the driving circuit 10.

Figure 9:
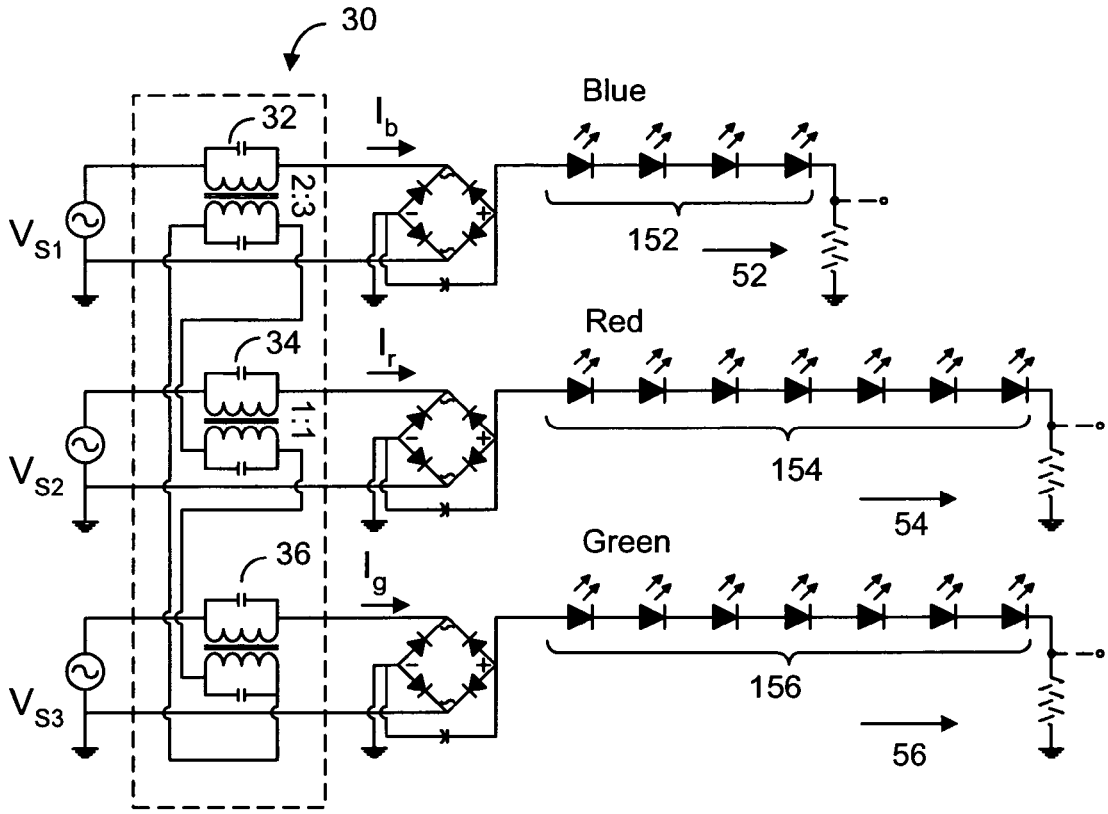
FIG. 9 is a circuit diagram showing another exemplary driving circuit having three current paths, according to the present invention.

FIG. 9 is an exemplary driving circuit for providing currents to three current paths of three different LEDs. As shown, the LEDs 152 in the current path 52 are blue, the LEDs 154 in the current path 54 are red and the LEDs 156 in the current path 56 are green. It is possible to select transformers 32, 34 and 36 to provide currents $I_b$, $I_r$ and $I_g$ to drive the corresponding LEDs. For example, the coil turn ratio in the first transformer 32 is 2:3, the coil turn ratio in the second transformer 34 is 1:1 and the coil turn ratio in the third transformer 36 is 1:2. If the current in the current loop is $I_F$, we have $$I_F=I_b(2/3)=I_r=I_g(1/2)$$

or $I_b=(3/2)I_r$ $$I_g=2I_r$$

If it is desirable to use red, green and blue LEDs to produce a white light source, it is possible to adjust the number of different color LEDs without changing the driving circuit 10. It is also possible to use a pulse width modulation (PWM) IC, for example, to change the current in different color LEDs to achieve an optimum white light output (see FIG. 11).

Figure 10:
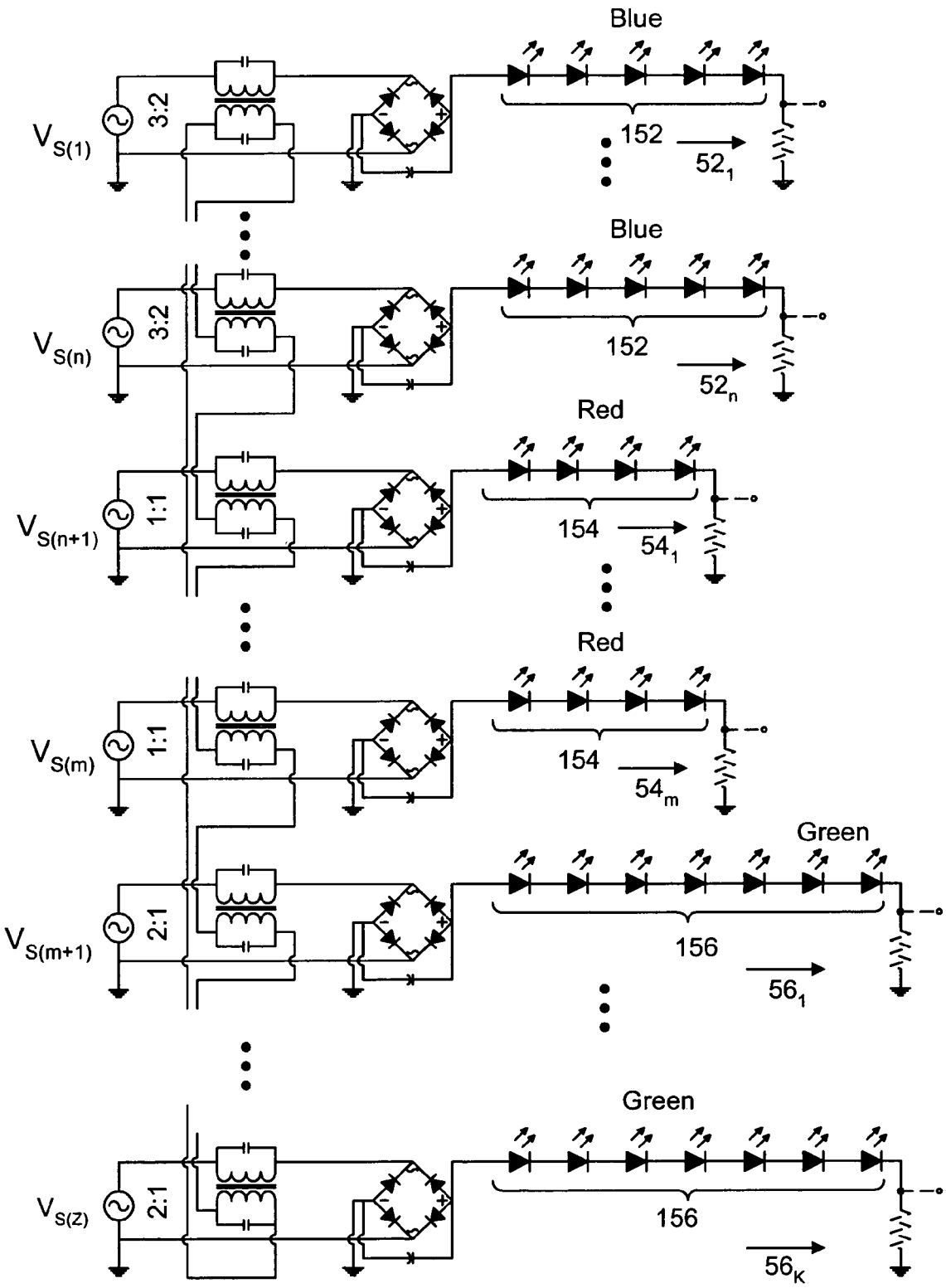
FIG. 10 is a circuit diagram showing a generalized driving circuit having a plurality of current paths, according to the present invention.

In a light source with a large source area, it is advantageous to use more than one current path to drive the LEDs of each color. As shown in FIG. 10, a plurality of transformers are used to drive blue LEDs 152 in current paths $\mathbf{52}_1 \ldots \mathbf{52}_m$, a plurality of transformers are used to drive red LEDs 154 in current paths $\mathbf{54}_1 \ldots \mathbf{54}_m$, and a plurality of transformers are used to drive green LEDs 156 in current paths $\mathbf{56}_1 \ldots \mathbf{56}_k$.

Figure 11:
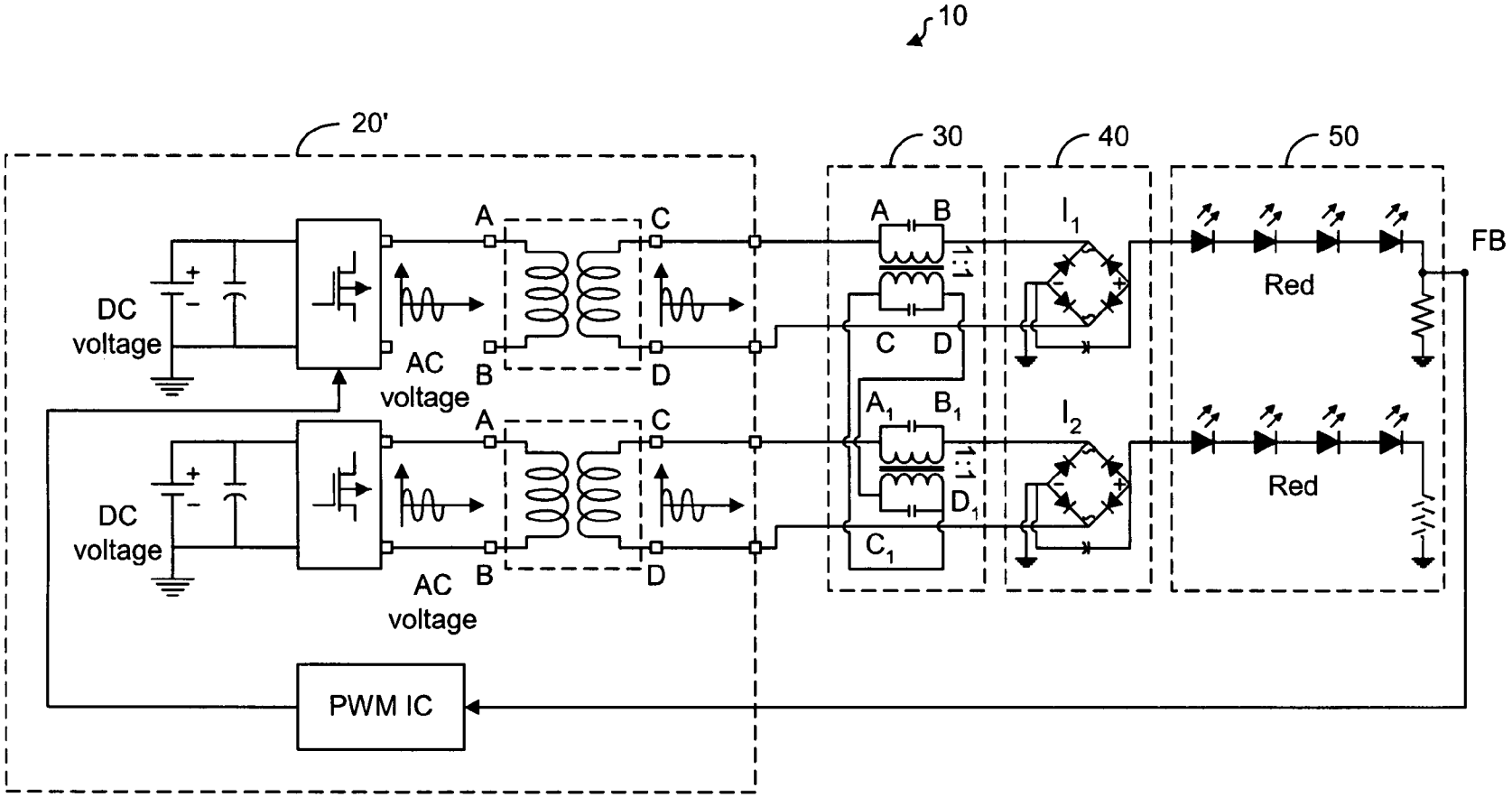
FIG. 11 is a circuit diagram showing an inverter driver having a pulse width modulator to adjust the current in a driving circuit.

FIG. 11 shows a driving circuit 10 having an inverter driver block 20', wherein power switches and transformers are used to convert DC power sources into AC power sources. The inverter driver block 20' further comprises a PWM IC 25 operatively connected to one of the power switches to adjust the current in various current paths in the light source 50. As such, the overall brightness of the light source 50 can be adjusted with a pulse width modulator.

In sum, the driving circuit, according to the present invention, uses a plurality of transformers to provide currents to a plurality of current paths for driving a plurality of LEDs. Each of the transformers has two induction coils magnetically coupled through the transformer core. Each transformer has a coil turn ratio according to the number of turns in each induction coil. One induction coil is used to provide an output current to a different current path and the other induction coil is connected to the corresponding induction coil of other transformer for forming a current loop. As such, the output current of each transformer has a relationship with the output current of the other transformers depending on the coil turn ratios of the connected transformers.

What is claimed is:

1. An electrical circuit for use with a light source, the light source having at least a first current path, a second current path, one or more first light-emitting devices connected to the first current path for receiving a first current from the electrical circuit, and one or more second light-emitting devices connected to the second current path for receiving a second current from the electrical circuit, wherein a ratio of the second current to the first current is R, said electrical circuit comprising:

an inverter driver section to provide electrical power;

a rectifying section having a first rectifier and a second rectifier; and a balanced transformer section disposed between the inverter driver section and the rectifying section, the balanced transformer section comprising:

a first transformer operatively connected between the inverter driver section and the first rectifier, the first transformer having a current providing coil for providing the first current, the current providing coil having a number of coil turns, and an induction coil magnetically coupled to the current providing coil for producing an induction current in response to the first current, the induction coil having a further number of coil turns with a first coil turn ratio between the number and the further number;

a second transformer operatively connected between the inverter driver section and the second rectifier, the second transformer having a current providing coil for providing the second current, the current providing coil having a number of coil turns, and an induction coil magnetically coupled to the current providing coil for producing an induction current in response to the second current, the induction coil having a further number of coil turns with a second coil turn ratio between the number and the further number, wherein the induction coil of the first transformer and the induction coil of the second transformer are connected to form a current loop for the induction current in the first and second transformers, and wherein a ratio between the first coil turn ratio and the second coil turn ratio is substantially equal to R.

2. The electrical circuit of claim 1, wherein the rectifying section further includes a third rectifier, the light source further having a third current path and one or more third light-emitting devices connected to the third current path, the third current path operatively connected to the inverter driver section through the third rectifier for receiving a third current, wherein a ratio of the third current to the first current is R', said electrical circuit further comprising:

a third transformer operatively connected between the inverter driver section and the third rectifying means, the third transformer having a current providing coil for providing the third current, the current providing coil having a number of coil turns, and an induction coil magnetically coupled to the current providing coil, the induction coil having a further number of coil turns with a third coil turn ratio between the number and the further number, wherein the induction coil of the third transformer is connected to the induction coils of the first and second transformers to form the current loop for the induction current in the first, second and third transformers, and wherein a ratio between the first coil turn ratio and the third coil turn ratio is substantially equal to R'.

3. A lighting panel comprising:

a light source, and a driving circuit for providing currents to the light source, the light source having at least a first current path, a second current path, one or more first light-emitting devices connected to the first current path for receiving a first current from the driving circuit, and one or more second light-emitting devices connected to the second current path for receiving a second current from the driving circuit, wherein a ratio of the second current to the first current is R, the driving circuit comprising:

an inverter driver section to provide electrical power;

a rectifying section having a first rectifier and a second rectifier; and a balanced transformer section disposed between the inverter driver section and the rectifying section, the balanced transformer section comprising:

a first transformer operatively connected between the inverter driver section and the first rectifier, the first transformer having a current providing coil for providing the first current, the current providing coil having a number of coil turns, and an induction coil magnetically coupled to the current providing coil for producing an induction current in response to the first current, the induction coil having a further number of coil turns with a first coil turn ratio between the number and the further number;

a second transformer operatively connected between the inverter driver section and the second rectifier, the second transformer having a current providing coil for providing the second current, the current providing coil having a number of coil turns, and an induction coil magnetically coupled to the current providing coil for producing an induction current in response to the second current, the induction coil having a further number of coil turns with a second coil turn ratio between the number and the further number, wherein the induction coil of the first transformer and the induction coil of the second transformer are connected to form a current loop for the induction current in the first and second transformers, and wherein a ratio between the first coil turn ratio and the second coil turn ratio is substantially equal to R.

4. The lighting panel of claim 3, wherein the rectifying section further includes a third rectifier, the light source further having a third current path and one or more third light-emitting devices connected to the third current path, the third current path operatively connected to the inverter driver section through the third rectifier for receiving a third current, wherein a ratio of the third current to the first current is R', the electrical circuit further comprising:

a third transformer operatively connected between the inverter driver section and the third rectifying means, the third transformer having a current providing coil for providing the third current, the current providing coil having a number of coil turns, and an induction coil magnetically coupled to the current providing coil, the induction coil having a further number of coil turns with a third coil turn ratio between the number and the further number, wherein the induction coil of the third transformer is connected to the induction coils of the first and second transformers to form the current loop for the induction current in the first, second and third transformers, and wherein a ratio between the first coil turn ratio and the third coil turn ratio is substantially equal to R'.

5. The lighting panel of claim 3, wherein the first light emitting devices are red light emitting devices, the second light emitting devices are green light emitting devices and the third light emitting devices are blue light emitting devices.

6. The lighting panel of claim 5, wherein the light source is used to provide white light having three color components:

a red color component provided by the red light emitting devices, a green color component provided by the green light emitting devices and a blue color component provided by the blue light emitting devices.

7. The lighting panel of claim 6, wherein at least one of the color components in the white light can be adjusted by changing a number of respective light emitting devices in the light source.

8. The lighting panel of claim 3, further comprising:

at least one current adjustment device disposed in the inverter driver section for adjusting the currents to the light source.

9. The light panel of claim 8, wherein the inverter driver section comprises at least one DC power source operatively connected to a DC-to-AC converter to provide the electrical power in AC form, and a switching means connected to the DC power source, and wherein the current adjustment device comprises a pulse width modulator operatively connected to the switching means for adjusting the electrical power.

* * * * *